US006474761B1

(12) United States Patent
Müterthies et al.

(10) Patent No.: US 6,474,761 B1
(45) Date of Patent: Nov. 5, 2002

(54) MOUNTING UNIT

(75) Inventors: Ralf Müterthies, Löhne (DE); Stefan Rüter, Bad Oeynhausen (DE); Carsten Meyer, Bielefeld (DE); Gerhard Schröder, Bad Oeynhausen (DE); Jörg Aufderheide, Spenge (DE)

(73) Assignee: Paul Hettich GmbH & Co., Kirchlengren (DE)

( * ) Notice: Subject to any disclaimer, the term of this patent is extended or adjusted under 35 U.S.C. 154(b) by 0 days.

(21) Appl. No.: 09/663,182

(22) Filed: Sep. 15, 2000

(30) Foreign Application Priority Data

Sep. 17, 1999 (DE) ..... 199 44 654

(51) Int. Cl.[7] ..... A47B 88/00
(52) U.S. Cl. ..... 312/348.1; 312/330.1
(58) Field of Search ..... 312/330.1, 334.1, 312/334.7, 334.14, 334.8, 348.1, 348.2, 348.4

(56) References Cited

U.S. PATENT DOCUMENTS

| | | | | |
|---|---|---|---|---|
| 3,029,357 A | | 4/1962 | Williams | 312/263 |
| 3,549,301 A | | 12/1970 | Harris et al. | 312/330.1 |
| 3,729,246 A | | 4/1973 | Harrell et al. | 312/330.1 |
| 5,197,791 A | | 3/1993 | Domenig | 312/348.1 |
| 5,370,454 A | | 12/1994 | Domenig | 312/348.1 |
| 5,433,518 A | | 7/1995 | Skov | 312/348.1 |
| 5,906,346 A | * | 5/1999 | Lin et al. | 411/508 X |
| 5,978,232 A | * | 11/1999 | Jo | 312/223.2 X |
| 5,992,958 A | * | 11/1999 | Scheible | 312/330.1 X |
| 6,053,592 A | * | 4/2000 | Sutterlutti | 312/348.1 X |

FOREIGN PATENT DOCUMENTS

| | | | | |
|---|---|---|---|---|
| DE | G 73 17 344.1 | | 5/1973 | |
| DE | GM 79 00 396 | | 6/1980 | |
| DE | G 83 33 251.0 | | 3/1984 | |
| DE | 3911353 | * | 10/1990 | 312/348.1 |
| DE | 40 16 452 A1 | | 9/1991 | |
| DE | G 93 11 493.1 | | 11/1993 | |
| DE | G 94 07 813.0 | | 9/1994 | |
| DE | 19726466 A1 | | 12/1998 | |
| EP | 551575 | * | 7/1993 | 312/348.2 |

* cited by examiner

*Primary Examiner*—James O. Hansen
(74) *Attorney, Agent, or Firm*—Barnes & Thornburg

(57) ABSTRACT

A mounting unit used for fastening a drawer to a pull-out slide formed of several rails which are displaceably disposed with respect to one another. The mounting unit has several connection elements, each having horizontally extending upper supporting edge which can be connected, at least partially, with an upper edge of an upper rail of the pull-out slide. Each connecting element also includes a downward extending center section and a horizontally extending bottom section on which the sliding bottom is at least partially held. This approximately Z-shaped construction distributes stress well, and reduces costs of manufacture because the connection elements are identical and can be used for the right and left side of a drawer.

13 Claims, 4 Drawing Sheets

MOUNTING UNIT

BACKGROUND AND SUMMARY OF THE INVENTION

The invention relates to a mounting unit for fastening a drawer or a sliding bottom into a furniture body.

Filed contemporaneously herewith are six United States patent applications, commonly assigned to Paul Hettich GmbH & Co.:

| INVENTOR(S) | TITLE | ATTY DOCKET |
|---|---|---|
| Müterthies, Rüter, et al. | Fastening Arrangement | 824/36770 |
| Müterthies, Rüter, et al. | Fastening Arrangement | 824/36771 |
| Müterthies, Rüter, et al. | Fastening Arrangement | 824/36773 |
| Müterthies, Rüter, et al. | Pull-out Slide Set | 824/36774 |
| Müterthies, Rüter, et al. | Partitioning System | 824/36775 |
| Müterthies, Rüter, et al. | Fastening Arrangement | 824/36785 |

The claims, drawings and specification of each of the foregoing applications is hereby specifically incorporated by reference into this specification as if set forth verbatim herein.

German Patent Document DE 73 17 344 U1 shows a pull-out slide for drawers wherein a connection piece to connect to the drawer is provided on a slide rail. The connection piece engages in a wedge-shaped section on a side wall of the drawer so that the drawer is fixedly connected with the slide rail. This document shows the connection piece laterally connected on a rail of the pull-out slide. Because the construction of the connection piece and of the rail is asymmetrical, separate right and left connection pieces and rails must be produced. This results in high manufacturing and storage costs. Additionally, errors can easily occur during the mounting. In addition, the connection piece is adapted specifically to the rail, and cannot easily be used for different drawers.

German Patent Document DE 197 26 466 A1 shows a drawer connected via a profile rail with a slide rail of a pull-out slide. The profile rail has a hinge-type construction enabling the drawer side wall to be folded parallel to the drawer bottom. For this purpose, recesses are provided in the profile rail which extend in the longitudinal direction and at which the profile rail can be bent. This construction reduces the mechanical capacity of stress of the profile rail. In addition, the profile rail is specifically adapted to the respective side walls and the bottom, and therefore can not be easily used for drawers of different sizes. Also, because of a lack of symmetrical construction, this profile rail can be used only for right or left pull-out slides, which increases the manufacturing and mounting expenditures.

The present invention provides a mounting unit in which the components can at least partially be used with either right or left sides of pull-out slides. Furthermore, the mounting unit is adaptable to high mechanical stress and should be flexibly usable for drawers and bottoms of different sizes and constructions.

According to the invention, a mounting unit is provided for fastening a drawer on a pull-out slide formed of several rails which are displaceably disposed with respect to one another, which pull-out slide has several connection elements. Each connection element has an upper supporting edge which extends essentially horizontally, and which can be connected at least partially with an upper edge of an upper rail of the pull-out slide. Each connection element also has a downward extending center section, and a horizontally extending bottom section on which the sliding bottom is at least partially held. As a result, each connection element has an approximately Z-shaped section which enables a distribution of force along the two horizontal sections and the vertical section. In addition, the Z-shaped section can be used equally well for right or left pull-out slides. Alternatively, only one type of pull-out slide may be provided in this embodiment, right or left connection elements are fastened, so that the synergistic effects on the basis of a symmetrical construction are at least partially utilized.

Because the arrangement uses several connection elements on a rail of a pull-out slide, the length of the sliding bottom as well as the height of the drawer can be freely designed. The fastening arrangement can therefore be used universally for different types and sizes of drawers. The mounting unit can thus be modularly assembled.

According to a preferred embodiment of the invention, the connection elements in the center section extend at least partially diagonally toward the horizontal bottom section. This ensures that the lower area of each connection element, which can be displaced with the sliding bottom, does not rub against a stationary lower rail of the pull-out slide, for example, in the event of lateral loading of the drawer.

The mounting unit can be produced at reasonable cost if the connection elements are manufactured from a bent metal sheet. This also ensures a sufficient stability for high mechanical stress.

A particularly stable support of the sliding bottom in lateral directions can be achieved if the intermediate section extends vertically adjacent to the bottom section in a lower area and a sliding bottom rests partially against the vertically extending area of the intermediate section.

If a vertically lateral section is connected with the upper rail of the pull-out slide, the connection element cannot be fastened exclusively to the horizontal supporting edge, which becomes difficult to access and is used as a sliding surface or for other purposes. Particularly when the connection element is riveted to the guide rail, the site of the rivet must be carefully selected; protruding rivets will obstruct running or sliding surfaces. Preferably an outward-stepped end section adjoins the lateral section, so that each connection element is essentially U-shaped. When a connection element is fastened laterally to a rail of the pull-out slide, protrusions remain at the fastening points. These protrusions may damage an adjoining side wall. However, when a stepped end section is provided, the side wall can rest on the stepped end so that clearance can be maintained between the protrusion and the side wall.

In another embodiment of the invention, two different types of connection elements are provided which are connected with a right or a left pull-out slide respectively. This permits the use of one type of pull-out slide for both sides of a drawer, which reduces the expenditures for the manufacturing, the storage and the mounting of the pull-out slides.

An attachment for fastening side wall elements is provided on each connection element so that the height of the drawer can be constructed corresponding to the attachment and additional fastening parts. The attachment may also be used for fastening a front plate or a rear wall so that the total number of fastening components will be reduced.

A particularly space-saving storage of a mounting unit with a sliding bottom will be achieved if each connection element has a pivoting part on the bottom section connectable with the sliding bottom. This permits a simple and fast mounting of a drawer.

If, in the case of a mounting unit, each pull-out slide has a lower rail which can be fixedly connected with a furniture body and which is constructed in its cross-section with respect to a horizontal plane symmetrically with the upper rail of the pull-out slide, the connection element on both sides of a pull-out slide can be applied to symmetrically opposite points.

The invention will be described in detail in the following by means of several embodiments with respect to the attached drawings.

DETAILED DESCRIPTION OF THE PREFERRED EMBODIMENT

Figure 1:
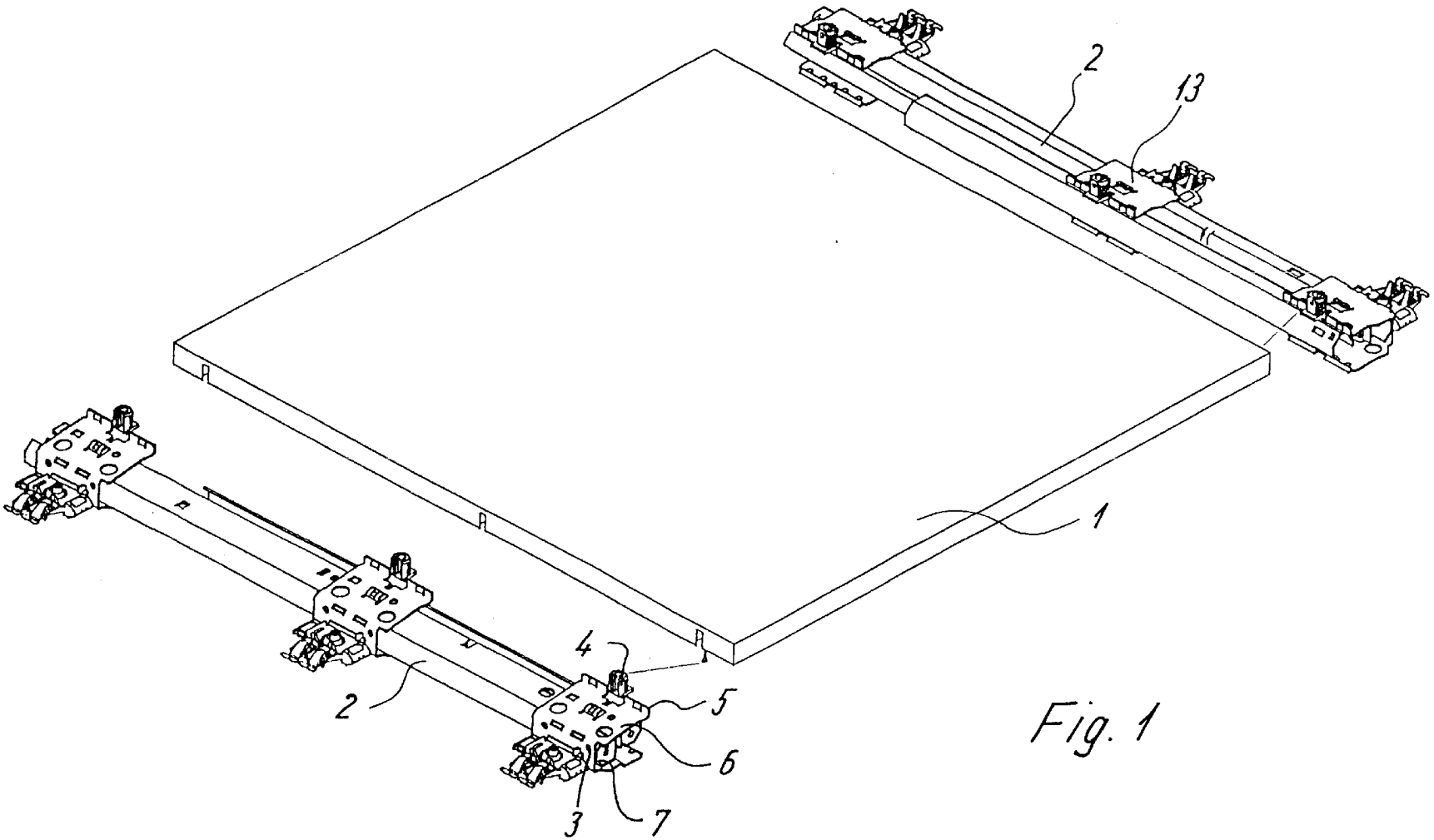
FIG. 1 is a perspective view of a first embodiment of a mounting unit according to the invention, shown with a sliding bottom.
Figure 2:
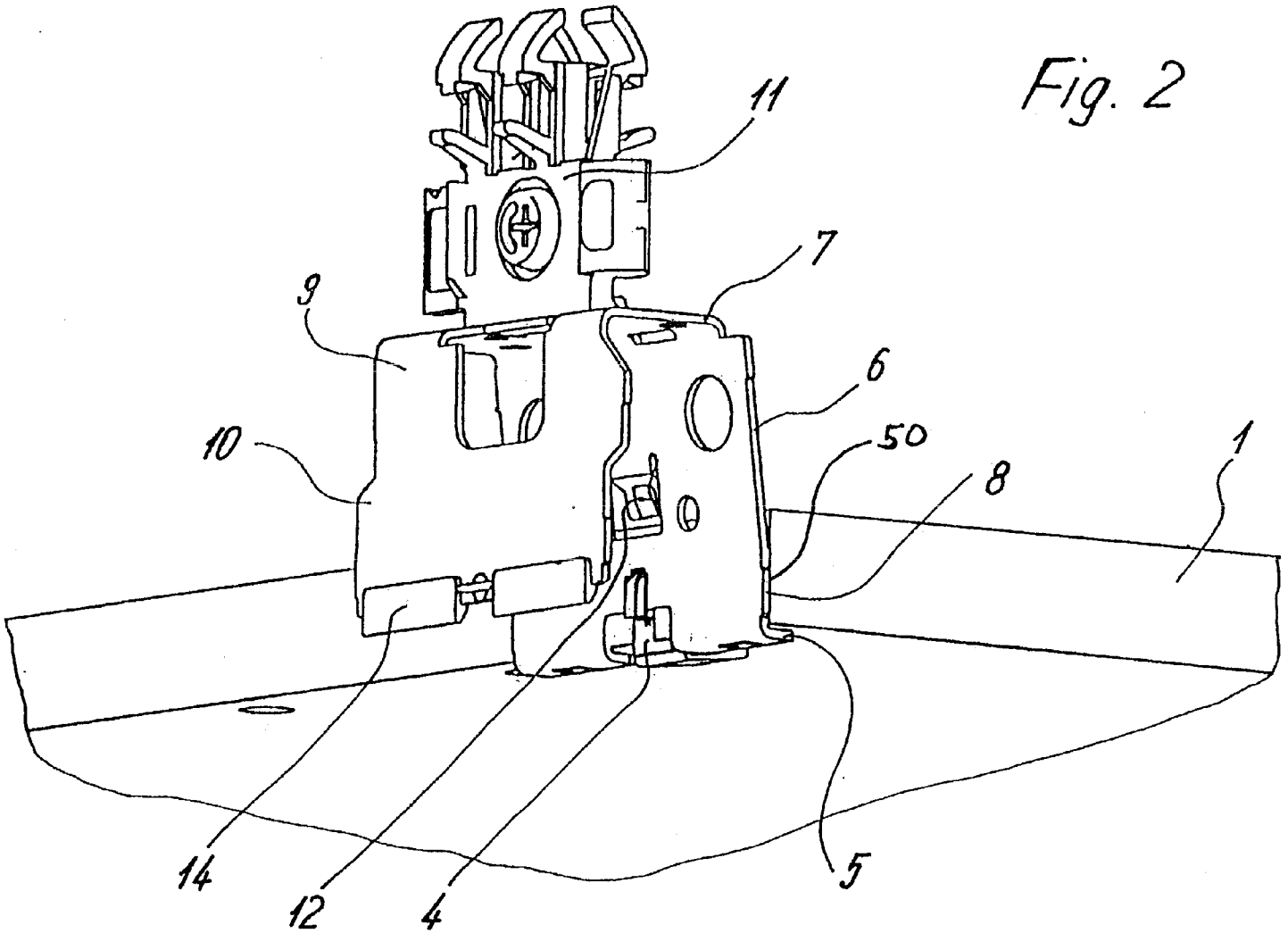
FIG. 2 is an enlarged perspective view of a connection element of FIG. 1.
Figure 3:
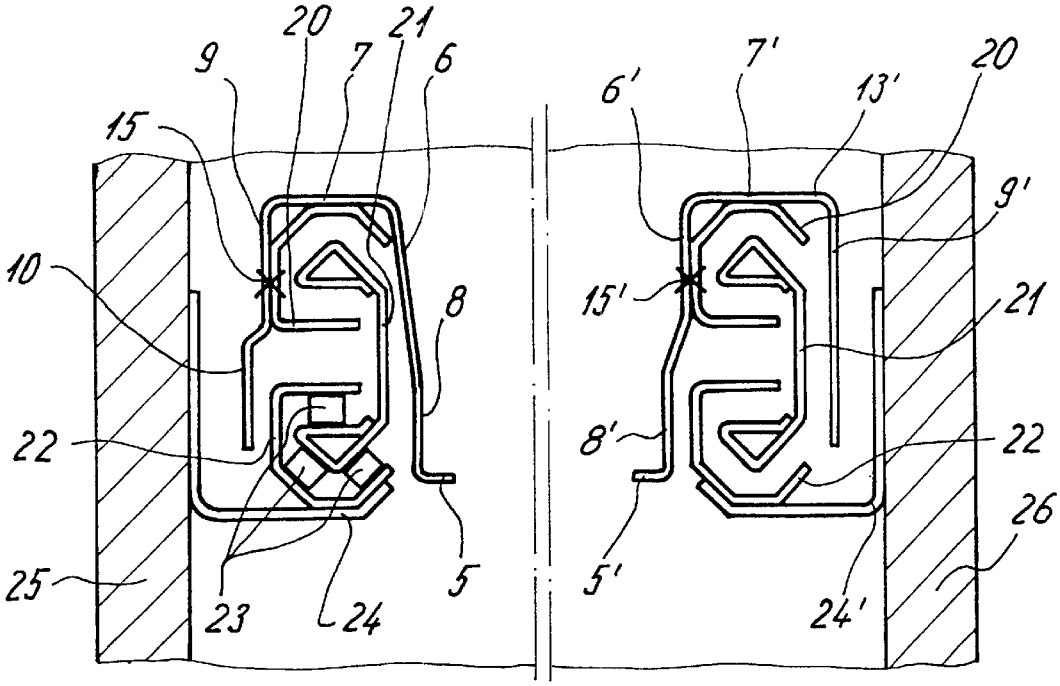
FIG. 3 is a schematic cross-sectional view of a right and left side of the mounting unit.

The mounting unit illustrated in FIGS. 1 to 3 is used for fastening a sliding bottom 1 of a drawer on a furniture body (not shown). For this purpose, connection elements 3 and 13, each made of sheet metal, are fastened on both sides of the sliding bottom 1 on a pull-out slide 2.

The sliding bottom 1 rests on a horizontally extending bottom section 5 of a connection element 3 on which a pin 4 is pivotally connected. The pin 4 engages a recess formed in the sliding bottom 1, so that the mounting unit can be stored in a flat condition together with the sliding bottom 1. The pin 4 has a catch device which engages a recess in a vertically extending center section 8 of the connection element 3. The lateral edge of the sliding bottom 1 rests against the intermediate section 50 of vertical center section 8, so that a stable connection is established between the sliding bottom 1 and the connection element 3.

The vertical center section 8 is adjoined by a diagonally extending center section 6 which adjoins a horizontal supporting edge 7. The diagonal center section 6 has a projection 12 to fasten a side wall element (not shown).

On the opposite side, each fastening element 3 has a vertical lateral section 9 adjoined by an end section 10 offset outwardly. A plastic attachment 11 is molded above the supporting edge 7 to fasten the side wall element, front plate, or a rear wall. The attachment 11 is molded on around an upward-bent area of the lateral section 9. In addition, recesses are provided in the area of the bends between the lateral section 9 and the supporting edge 7, and the center section 6 and the supporting edge 7. These recesses ease the task of bending the metal sheet.

Plastic projections 14 are molded on the underside of the end section 10, on which side wall elements rest in the completely mounted condition.

FIG. 3 is a cross-sectional view of a left connection element 3 and a right connection element 13 without the attachment 11. On the lateral section 9, a fastening 15 is provided which may be riveted, screwed, soldered, welded or glued.

The pull-out slide 2 includes an upper rail 20, a center rail 21 and a lower rail 22. Roller bodies 23 are between the individual rails 20, 21 and 22. By way of example, roller bodies are shown between only the lower rail 22 and the center rail 21, but are also provided between the other rails. The roller bodies 23 are triangular to distribute stress along the pull-out slide and ensure a precise course of the rails 20, 21 and 22 in the pull-out direction. The pull-out slide 2 is disposed on the lower rail 22 on a holding strip 24 which is fixed to a side wall 25 of a furniture body (not shown).

FIG. 3 shows a connection element 13 fastened at reference number 15' to the upper rail 20 of a pull-out slide. The left connection element 3 and the right connection element 13 do not have an identical construction, but the right connection element 13 has a first vertically extending center section 6' which extends diagonally outwardly, leading to another vertical center section 8', which leads to the bottom section 5'. In addition, the connection element 13 adjacent the right side wall 26 of the furniture body with an unstepped lateral section 9' which extends away from the pull-out slide 2.

Although a left connection element 3 and a right connection element 13 are provided in the embodiment, the pull-out slides 2 for the right and the left side have an identical construction. Thus, when the drawer is manufactured, only one type of pull-out slide must be produced.

Figure 4:
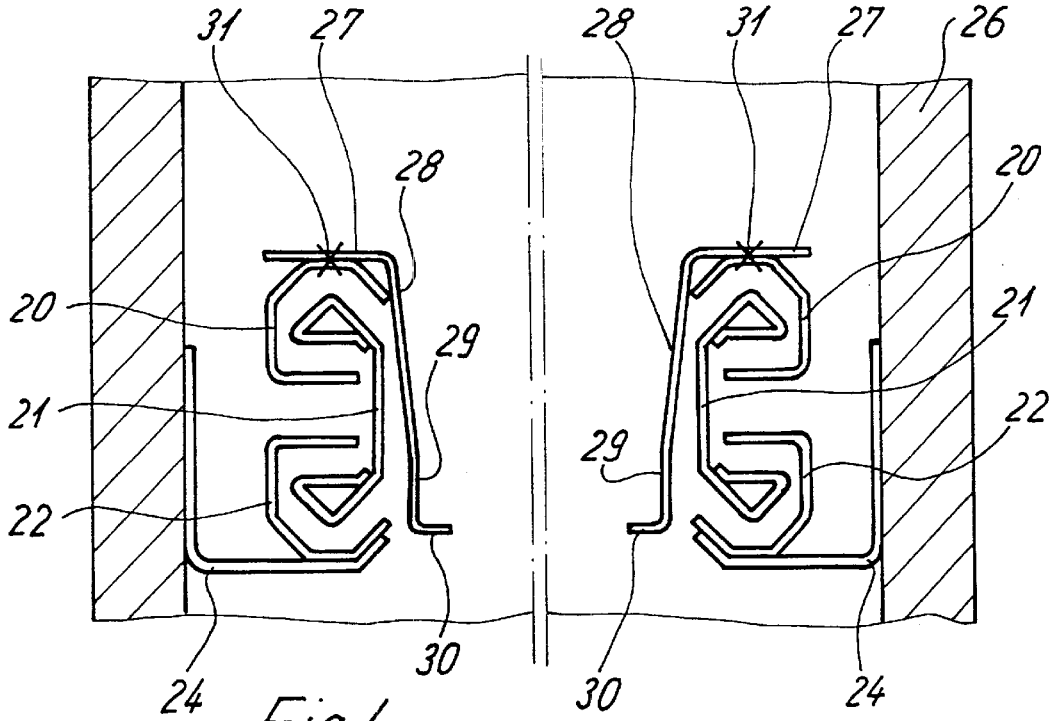
FIG. 4 is a schematic cross-sectional view of a right and left side of a mounting unit according to another embodiment.

FIG. 4 illustrates a modified embodiment of a mounting unit. In this case, the pull-out slides with the rails 20, 21 and 22 have the same construction for the right and the left side. In addition, the connection elements also have an identical construction, the latter having been rotated by 180° for the adaptation to the mounting position. Each connection element has a supporting edge 27 which is fastened to the upper rail 20 of the pull-out slide at reference number 31. A center section 28, slopes diagonally inward and extends adjacent to the supporting edge 27. A vertical center section 29 adjoins the lower area of the center section 28. In addition, a bottom section 30 enables a sliding bottom 1 to be fastened to the mounting unit in a stable manner. The other components can be constructed as in the embodiment illustrated in FIGS. 1 to 3.

Figure 5:
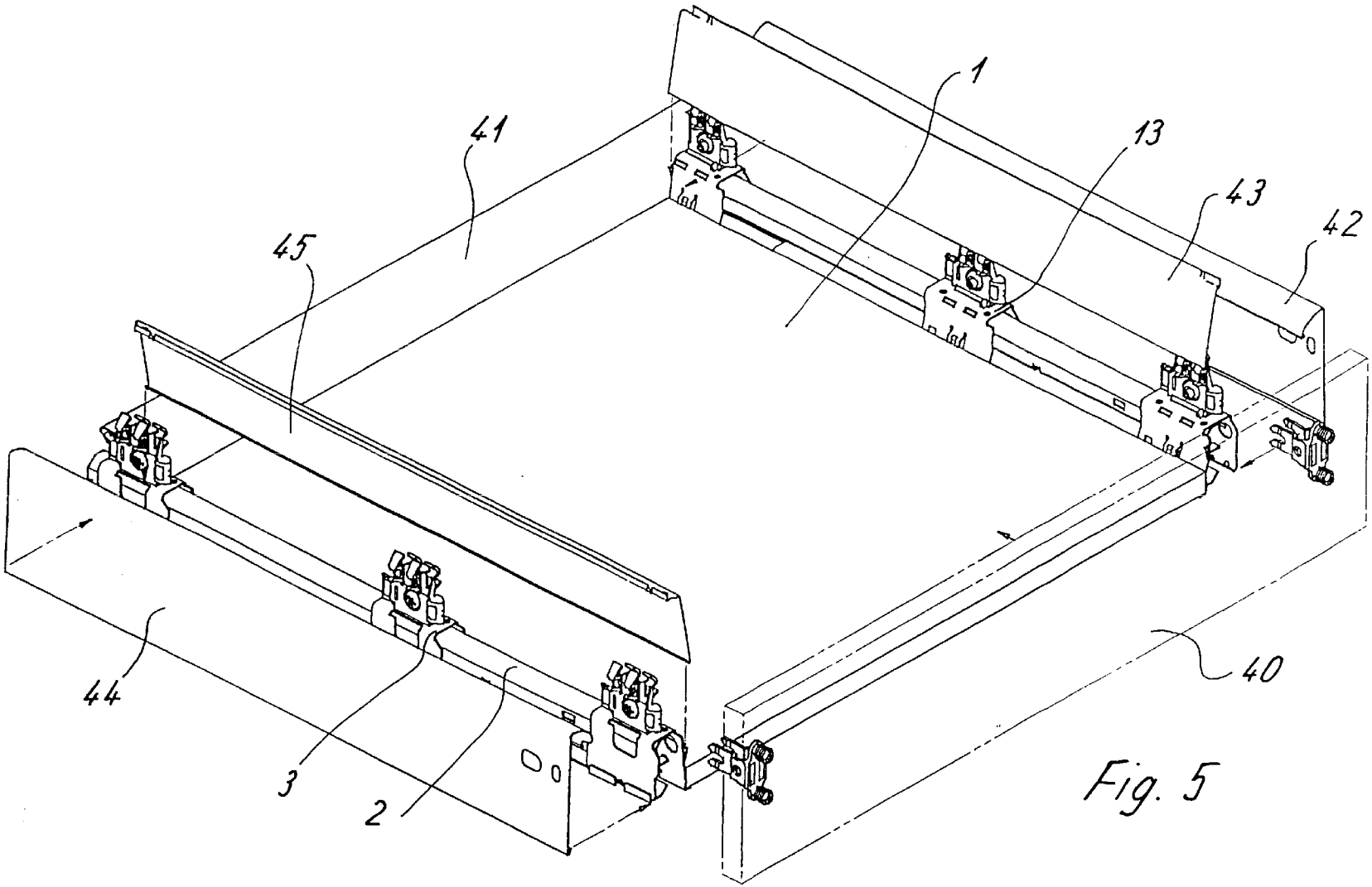
FIG. 5 is a perspective view of a drawer having a mounting unit according to FIG. 1.

The installation of a mounting unit is shown in FIG. 5. On its two sides, a sliding bottom 1 is connected with connection elements 3 and 13 respectively. One pull-out slide 2 respectively is fastened to the connection elements 3 and 13. After the folding-up and locking of the connection elements 3 and 13, a front panel 40 and a rear wall 41 are fastened to two connection elements 3 and 13 respectively via fastening devices (not shown). Right and left side wall elements 42, 43, 44 and 45 are then mounted on the connection elements 3 and 13. Finally, the complete drawer is installed in a furniture body.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A mounting unit for fastening a drawer or sliding bottom on a pull-out slide formed of at least two spaced generally parallel rails disposed displaceably to one another on opposite sides of the drawer or sliding bottom, the mounting unit comprising:

a plurality of connection elements for connection to a rail on one side and a plurality of connection elements for connection to a rail on the opposite side, each connection element having an upper supporting edge which extends essentially horizontally and is adapted for connection with an upper edge of an upper rail of the pull-out slide;

each connection element having a substantially vertically extending center section and a horizontally extending bottom section adapted for connection to the drawer or sliding bottom; and further comprising an intermediate section adjacent the bottom section, and a sliding bottom rests at least partially against a vertically extending area of the intermediate section.

2. A mounting unit according to claim 1, wherein two different types of connection elements are provided: connectable with one side rail or the opposite side rail of the pull-out slide, respectively.

3. A mounting unit for fastening a drawer or sliding bottom on a pull-out slide formed of at least two spaced generally parallel rails disposed displaceably to one another on opposite sides of the drawer or sliding bottom, the mounting unit comprising:

a plurality of connection elements for connection to a rail on one side and a plurality of connection elements for connection to a rail on the opposite side, each connection element having an upper supporting edge which extends essentially horizontally and is adapted for connection with an upper edge of an upper rail of the pull-out slide each connection element having a substantially vertically extending center section and a horizontally extending bottom section adapted for connection to the drawer or sliding bottom, and further comprising a pivoting part on the bottom section of the connection element, each pivoting part connectable to the sliding bottom.

4. A mounting unit for fastening a drawer or sliding bottom on a pull-out slide formed of at least two spaced generally parallel rails disposed displaceably to one another on opposite sides of the drawer or sliding bottom, the mounting unit comprising:

a plurality of connection elements for connection to a rail on one side and a plurality of connection elements for connection to a rail on the opposite side, each connection element having an upper supporting edge which extends essentially horizontally and is adapted for connection with an upper edge of an upper rail of the pull-out slide;

each connection element having a substantially vertically extending center section and a horizontally extending bottom section adapted for connection to the drawer or sliding bottom;

each pull-out slide having a lower rail connectable to a furniture body, the upper rail and lower rail being substantially symmetrically constructed with respect to a horizontal plane extending between the upper rail and lower rail.

5. A mounting unit for fastening a drawer or sliding bottom on a pull-out slide formed of at least two spaced generally parallel rails disposed displaceably to one another on opposite sides of the drawer or sliding bottom, the mounting unit comprising:

a plurality of connection elements for connection to a rail on one side and a plurality of connection elements for connection to a rail on the opposite side, each connection element having an upper supporting edge which extends essentially horizontally and is adapted for connection with an upper edge of an upper rail of the pull-out slide;

each connection element having a substantially vertically extending center section that extends at least partially diagonally toward the horizontal bottom section and a horizontally extending bottom section adapted for connection to the drawer or sliding bottom; and further comprising an intermediate section adjacent the bottom section, and a sliding bottom rests at least partially against a vertically extending area of the intermediate section.

6. A mounting unit according to claim 5, the connection elements being produced from a bent metal sheet.

7. A mounting unit for fastening a drawer or sliding bottom on a pull-out slide formed of rails disposed displaceably to one another and on opposite sides of the drawer or sliding bottom the mounting unit comprising:

horizontally spaced generally parallel rails, each rail being positioned for supporting opposite sides of a drawer or sliding bottom;

a plurality of connection elements for each rail, each connection element having an upper supporting edge which extends essentially horizontally and is connectable at least partially with an upper edge of an upper rail of the pull-out slide;

each connection element having a downwardly extending center section and a horizontally extending bottom section for connection to the drawer or sliding bottom.

8. A mounting unit according to claim 7, the supporting edge being adjoined by a vertically extending lateral section connectable with the upper rail of the pull-out slide.

9. A mounting unit according to claim 8, the lateral section being adjoined by an outward-stepped end section so that each connection element is essentially U-shaped.

10. A mounting unit according to claim 9, each pull-out slide having a lower rail connectable to a furniture body, the upper rail and lower rail being substantially symmetrically constructed with respect to a horizontal plane extending between the upper rail and lower rail.

11. A mounting unit according to claim 8, wherein two different types of connection elements are provided: connectable with one side rail or the opposite side rail of the pull-out slide, respectively.

12. A mounting unit according to claim 8, each pull-out slide having a lower rail connectable to a furniture body, the upper rail and lower rail being substantially symmetrically constructed with respect to a horizontal plane extending between the upper rail and lower rail.

13. A mounting unit according to claim 7, each pull-out slide having a lower rail connectable to a furniture body, the upper rail and lower rail being substantially symmetrically constructed with respect to a horizontal plane extending between the upper rail and lower rail.

* * * * *